US006354754B1

(12) United States Patent
Pan

(10) Patent No.: US 6,354,754 B1
(45) Date of Patent: Mar. 12, 2002

(54) PEN WITH A BUILT-IN SLIP PAPER

(76) Inventor: Chih-Teng Pan, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/871,913

(22) Filed: Jun. 4, 2001

(51) Int. Cl.[7] ..... B43K 29/12
(52) U.S. Cl. ..... 401/195
(58) Field of Search ..... 401/195, 52, 99, 401/111

(56) References Cited

U.S. PATENT DOCUMENTS 2,073,719 A * 3/1937 Ross ..... 401/195
3,963,358 A * 6/1976 Houser ..... 401/195
4,030,842 A * 6/1977 White et al. ..... 401/195
4,963,048 A * 10/1990 Thomas et al. ..... 401/195
D329,459 S * 9/1992 Sullivan ..... 401/195

* cited by examiner

*Primary Examiner*—Charles R. Eloshway

(57) ABSTRACT

A pen with a built-in slip paper, which comprises mainly an inner tube and an outer tube, and a gap is furnished between the two tubes; both the inner tube and the outer tube are furnished with two corresponding elongate slots; an ink tube in the inner tube is used for mounting a paper-roll cylinder, of which one end is pushed with a spring to prevent the paper roll from loosening; the paper end of the paper roll is to be pulled out of the elongate slot; after the inner and outer tubes are rotate and positioned, the paper surface of the slip paper will pass and show in the paper-pushing hole, and it can be pulled out by pushing the paper end so as to tear a piece of slip paper off.

4 Claims, 8 Drawing Sheets

PEN WITH A BUILT-IN SLIP PAPER

BACKGROUND OF THE INVENTION

1. Field of the Invention

This invention relates to a pen, and particularly to a pen with a built-in slip paper.

2. Description of the Prior Art

In our daily life, people often encounter a trifling matter; i.e., there is no slip paper available upon being necessary to take a short message or the like; after a while, a piece of paper might be found, but the thing needs to remember might be confused or forgotten.

In order to provide a pen with a slip paper, a patent application, "A Pen with A Slip Paper" No. 77208704 has been filed in Taiwan; in the application, the penholder has an elongate slot, in which a shaft is used for mounting a paper roll. The shaft and the ink tube are connected together; the upper end of the shaft of a slip paper is mounted with a rotary knob attached with a ratchet wheel. The end of a slip paper is placed through the elongate slot so as to facilitate the slip paper to be pulled out. The shaft can be turned by moving the knob. A built-in wedge-shaped member in the pen is used for cutting the slip paper glued so as to pull a piece of slip paper for writing.

Another conventional pen with a slip-paper structure was filed under a title of "Ball Pen with A Slip Paper Device" under No. 81206055, in which the upper part of the penholder has a hollow space, while the bottom center thereof is furnished with a round bar mounted with a ratchet wheel; the ratchet wheel includes two layers, of which the lower layer is a ratchet wheel with a catch pawl to control the wheel to rotate only in one direction, while the upper layer is a granular wheel having a shape corresponding to that of the penholder so as to facilitate the round bar to rotate. The shaft of the ratchet wheel is connected with the paper roll so as to have the slip paper moved out of the slot of the penholder; the slot has a knife-like edge to tear the paper pulled out; a cap is mounted over the paper roll so as to provide the functions of feeding paper, tearing and preventing from turning backwards, and to facilitate the slip paper to be torn off.

In the conventional pen having a slip paper, the tearing line of the elongate paper roll is usually in a straight-line shape; the elongate slot of the penholder is in contact with the paper roll directly. After a paper roll is loaded in the penholder, the paper roll is firmly loaded therein without having any difficulty for feeding paper during initial operation period; however, after several pieces of paper are pulled out, the paper-feeding condition will not be quite smooth as a result of the paper roll becoming looser and looser and the feeding force of the shaft becoming weaker and weaker.

SUMMARY OF THE INVENTION

The prime feature of the present invention is that both the inner tube and the outer tube are furnished with two corresponding elongate slots respectively; a paper-pushing hole is furnished beside the elongate slot in the outer tube, and the paper-pushing hole can facilitate the paper end of the slip paper to be pushed out of the elongate slot for further pulling.

Another feature of the present invention is that both the inner tube and the outer tube are furnished with two corresponding elongate slots respectively; the two elongate slots can be rotated for positioning after a slip paper mounted in place; the inner tube has a catch point for preventing the inner and outer tubes from sliding upon the slip paper being pulled.

Still another feature of the present invention is that a gap is furnished between the inner tube and the outer tube to facilitate the slip paper to be pulled so as to reduce paper-pulling resistance, and to provide the slip paper with a clamp force.

A further feature of the present invention is that one end of the paper roll is glued with a shaft of the paper-roll cylinder; the center hole of the paper cylinder is loaded with an ink tube, which is plugged in a cylindrical hole of a connection tube; one end of the paper-roll cylinder is pushed against the end of the connection tube, and the other end thereof is pushed with a spring; the contact surfaces thereof are in close contact and friction condition each other so as to prevent the paper roll in the inner tube from loosening.

A still further feature of the present invention is that after the paper roll is loaded in the cylindrical hole of the inner tube, one end of the paper roll is glued together with the paper-roll cylinder, while the other end thereof is pulled to the edge of the elongate slot of the outer tube. The rolled portion of the paper roll is in a tight-rolled condition; both ends thereof are fastened in place, and the paper roll is not in a loose condition, which often causes more or less difficulty upon pulling.

DETAILED DESCRIPTION OF THE PREFERRED EMBODIMENT

Figure 1:
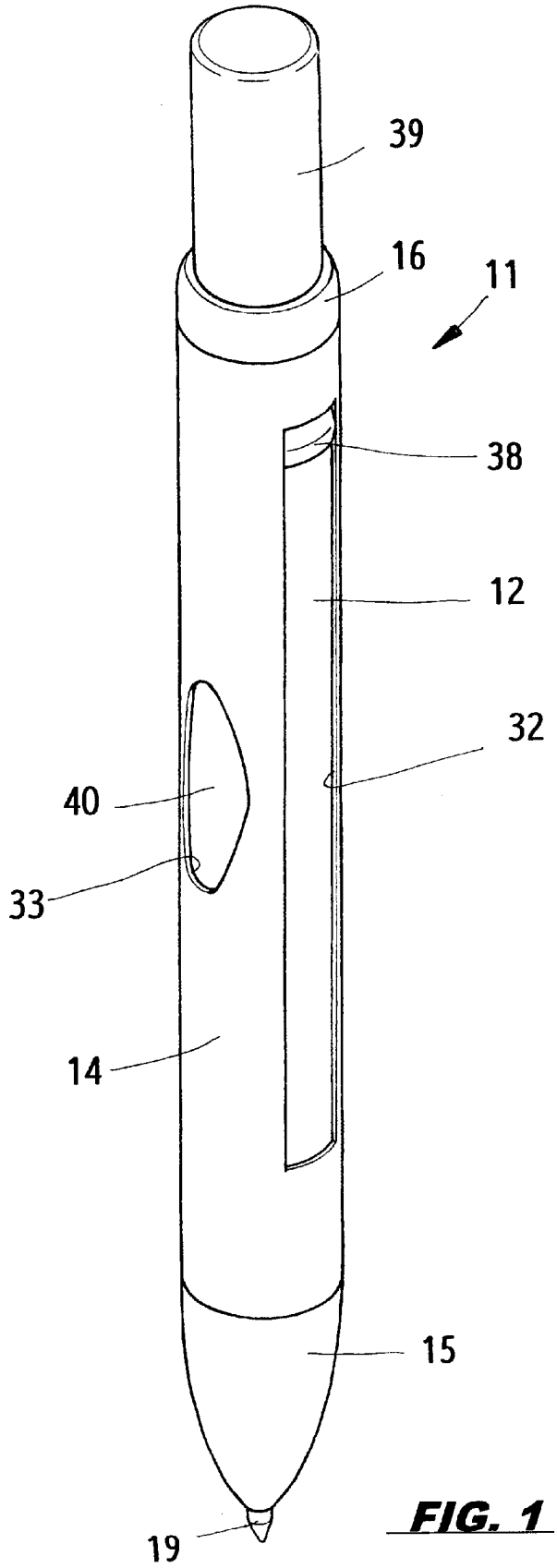
FIG. 1 is a perspective view of the present invention, showing the outer structure thereof.
Figure 2:
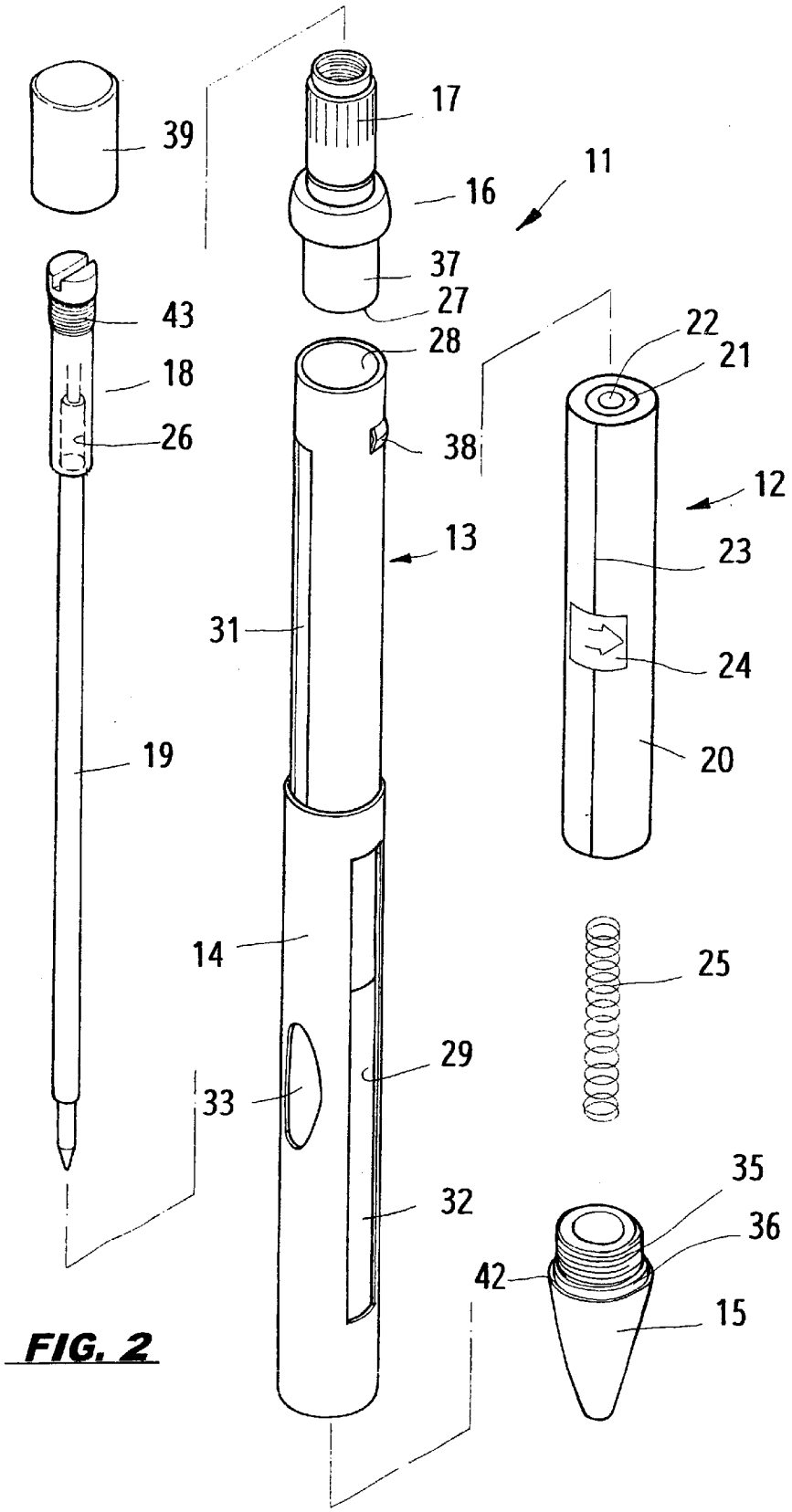
FIG. 2 is a disassembled view of the present invention, showing the relation among parts thereof.
Figure 3:
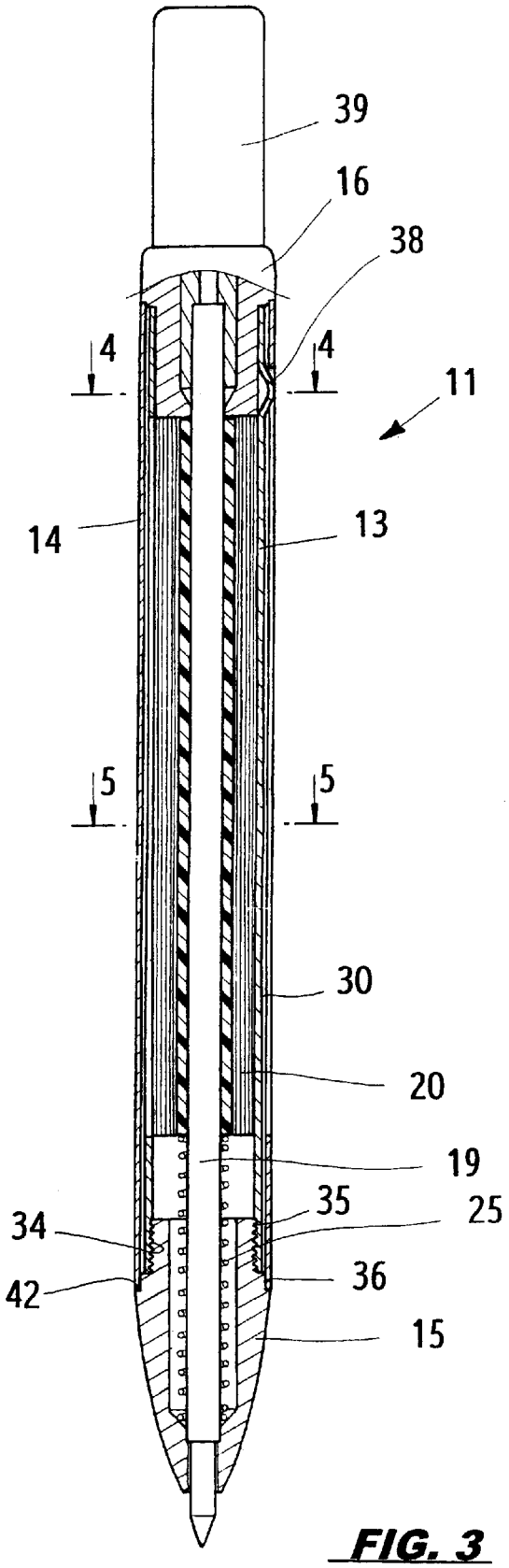
FIG. 3 is a sectional view of the present invention, showing the relation among assemblies thereof.
Figure 4:
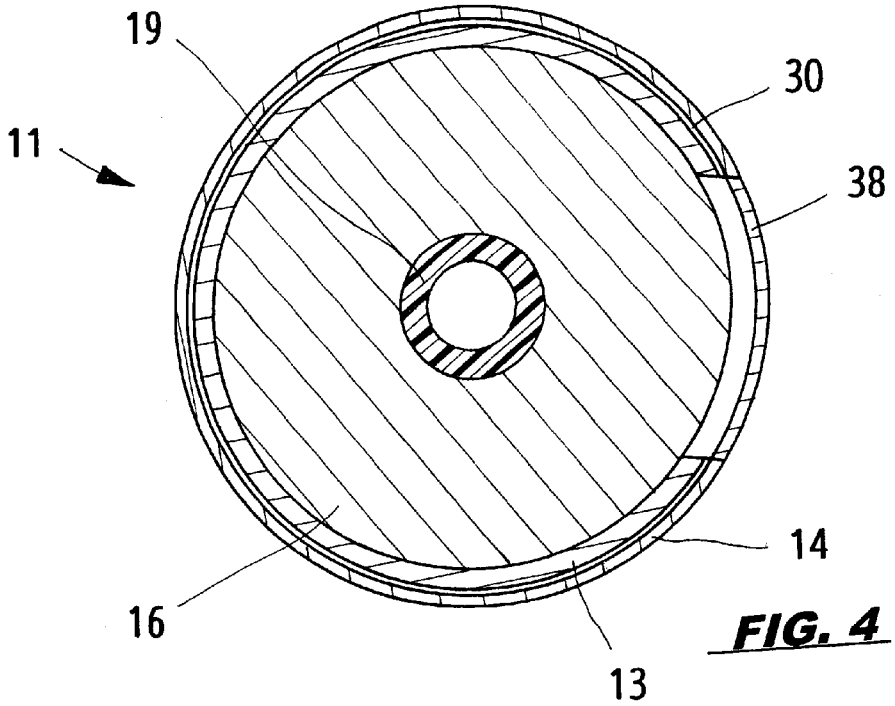
FIG. 4 is a sectional view of the present invention, showing a line 4—4 in FIG. 3.
Figure 5:
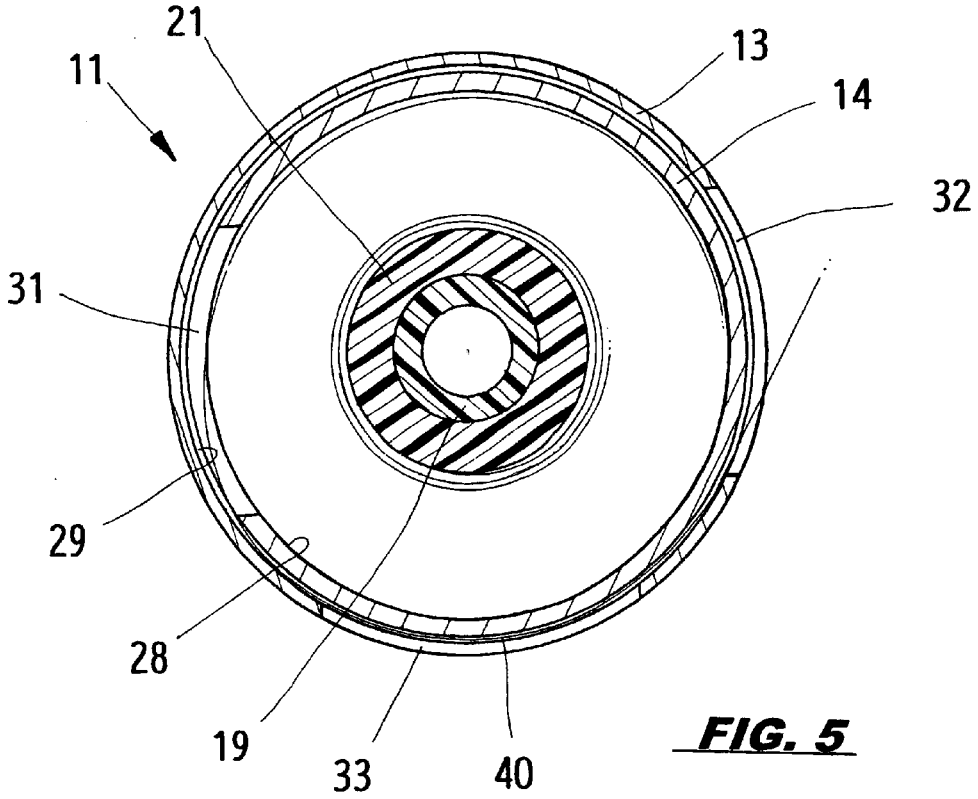
FIG. 5 is a sectional view of the present invention, showing a line 5—5 in FIG. 3.

Referring to FIGS. 1 to 4, the pen 11 according to the present invention comprises a slip paper 12, an inner tube 13, an outer tube 14, a pen head 15, a rotation cap 16, a connection tube 18, an ink tube 19 and a spring 25; one end of the inner tube 13 and the rotation cap 16 are riveted together; the other end thereof is mounted with a tail cap 39. The upper end of the rotation cap 16 is mounted with a knob 17 so as to have a connection tube 18 mounted thereon; the other end of the connection tube 18 has a cylindrical hole 26 for receiving an ink tube 19. The inner tube 13 is mounted with an outer tube 14 and a pen head 15. The rotation cap 16 can be rotated so as to have the ink tube 19 moved up and down for writing.

The inner tube 13 and the outer tube 14 are made of thin tubes; the cylindrical hole 28 of the inner tube has a space for receiving a paper roll 20 of slip paper 12; one end of the inner tube 13 is riveted together with a connection bar 37 of the rotation cap 16 to provide the inner tube 13 with a rotation force. The inner tube 13 has an elongate slot 31 having a suitable width; the width of the elongate slot 31 is slightly less than that of the paper roll 20 of a slip paper 12. One end of the inner tube is punched with a catch point 38 beside the elongate slot 31; the catch point 38 is used for assembling the inner and outer tubes 13 and 14 together. After the paper end 23 of a slip paper 12 is pulled out, and after the inner and outer tubes 13 and 14 are rotated at a given angle, the catch point 38 will detain, the elongate slot 32 of the outer tube 14 so as to prevent the inner tube 13 separating from the outer tube 14. One end of the inner tube 13 is furnished with inner threads 34 to be engaged with the outer threads 35 of the pen head 15.

Figure 10:
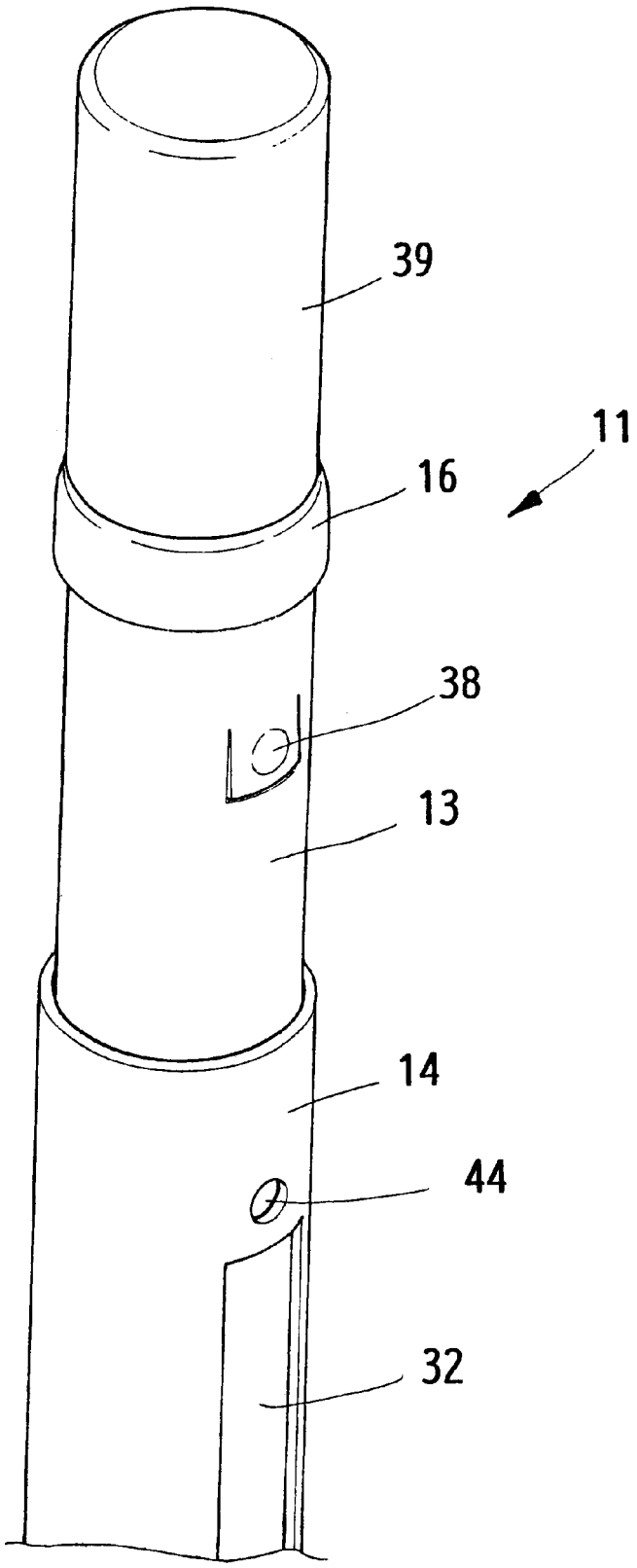
FIG. 10 is a disassembled view of the present invention, showing the structure of the catch hole between the inner tube and the outer tube.

The cylindrical hole 29 of the outer tube 14 is slightly larger than the outer diameter of the inner tube 13; the length of the outer tube 14 is also slightly longer than that of the inner tube 13. After the outer tube 14 is mounted on the inner tube 13, both the inner and outer tubes 13 and 14 are in register condition near the end of the rotation cap 16; the other end of the outer tube 14 is slightly longer than that of the inner tube 13; the inner and outer tubes 13 and 14 have corresponding elongate slots 31 and 32 respectively, both two elongate slots 31 and 32 have the same width. Both ends of the elongate slots 31 and 32 near the pen head 15 are in register condition, Near the rotation cap 16, the elongate slot 32 of the outer tube 14 is slightly higher than the catch point 38 on the inner tube 13. The catch point 38 and the upper end of the elongate slot 32 of the outer tube 14 can provide a detaining function for limiting the inner and outer tubes 13 and 14 from rotation freely. As shown in FIG. 10, the outer tube 14 has a catch hole 44 corresponding the catch point 38 of the inner tube 13; after a slip paper 12 is loaded into the cylindrical hole 28 of the inner tube 13, and after the inner and outer tubes 13 and 14 are rotated to a given position, the catch point 38 and the catch hole 44 will provide a detaining and positioning function to prevent the inner and outer tubes 13 and 14 from rotating freely.

The mid-part at one side of the elongate slot 32 of the outer tube 14 has a paper-pushing hole 33, which is preferred a triangular hole, or may be an oblong hole or the like; the paper-pushing hole 33 is used for facilitating a thumb to push the paper surface 40 out of the elongate slot 32 of the outer tube 14; then, a hand of a user can pull the paper end outwards and tear a given length desired.

The lower ends of the inner and outer tubes 13 and 14 are screwed up in the pen head 15; the center of the tubes has a cylindrical hole for receiving and direction an ink tube 19; the outer end thereof has outer threads 35 to be engaged with inner threads 34 of the inner tube 13. One end of the outer threads 35 has a cylindrical surface 36 with a larger diameter. The cylindrical surface 36 is to be mounted with one end of the outer tube 14. After the pen head 15 is screwed to the inner threads 34 of one end of the inner tube 13, a very narrow space will be left between the end of the outer tube 14 and the positioning shoulder 42 so as to have the outer tube 14 not screwed up tightly.

The upper end of the connection tube 18 is furnished with threads 43, and the other end thereof has a cylindrical hole 26 for plugging and connecting one end of the ink tube 19. The connection tube 18 is connected with the knob 17 of the rotation cap 16 by means of threads 43 thereof; the knob 17 can drive the ink tube 19 to move upon being rotated. The cylindrical hole 26 of the connection tube 18 is connected with the ink tube 19. The surface of the ink tube 19 is mounted in a cylindrical hole 22 of a paper-roll cylinder 21 of the slip paper 12; i.e., the ink tube 19 becomes a shaft to support the paper roll 20 of the slip paper 12.

After a paper roll 20 is loaded in the cylindrical hole 28 of the inner tube 13, one end of the paper roll 20 is glued to the paper-roll cylinder 21, and the while slip paper 12 will be rolled tightly in place. The paper end 23 of the paper roll is glued with a glue label 24 to show a direction. The center of the paper-roll cylinder 21 has a cylindrical hole 22, which is in contact with the outer diameter of the ink tube 19 with a slight tightness; i.e., the paper roll 20 mounted on the ink tube 19 would not slide freely. After a paper roll 20 is loaded into the cylindrical hole 28 of the inner tube 13 of the pen 11, one end of the paper-roll cylinder 21 of the paper roll 20 must push against the end surface 27 of the connection bar 37 of the rotation cap 16; the outer surface of the ink tube 19 is mounted with a spring 25 to push the paper-roll cylinder 21 of the paper roll 20 so as to have the paper-roll cylinder 21 positioned in place without loosening, sliding and turning freely; i.e., the slip paper 12 would not loosen after being used up a given portion of length.

Figure 6:
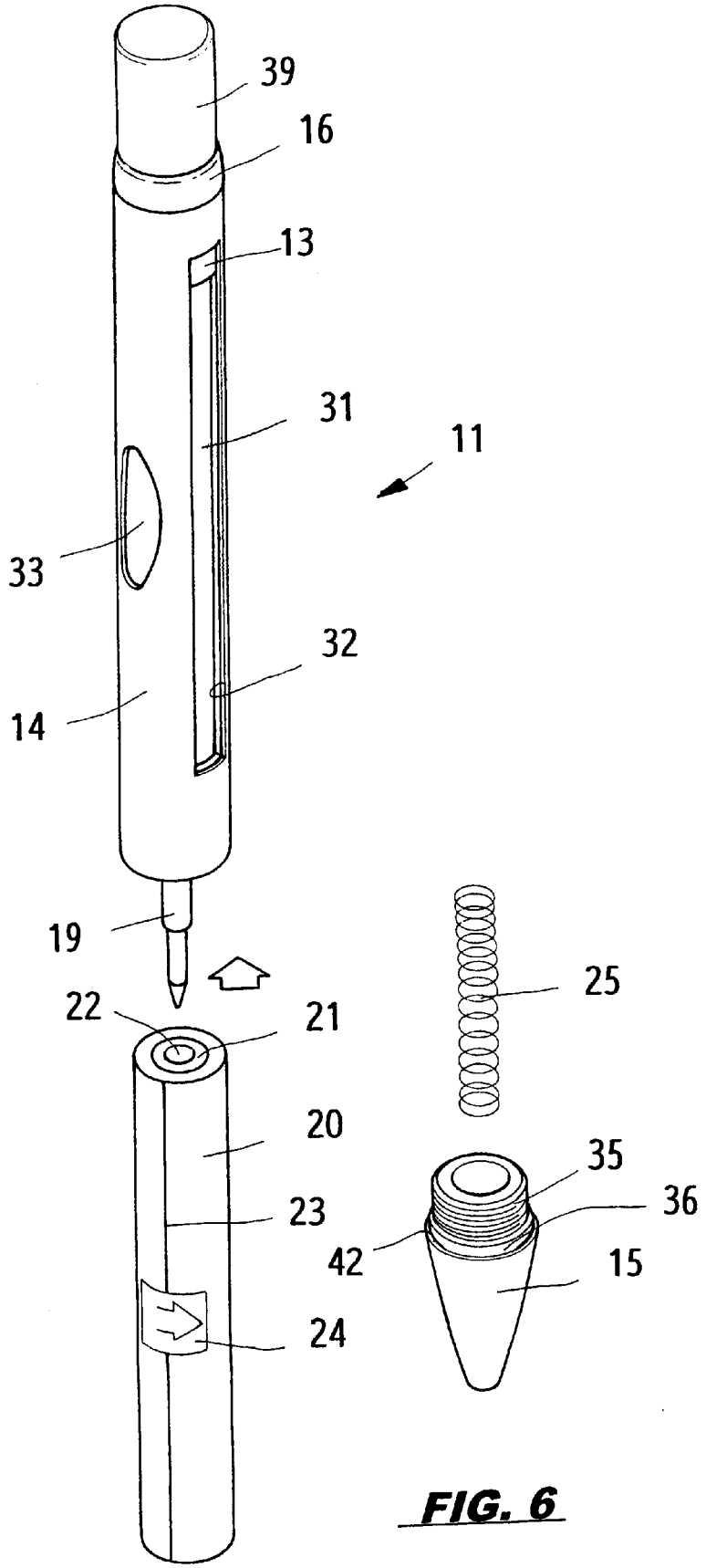
FIG. 6 is a disassembled view of the present invention, showing a paper roll to be mounted in an inner tube.
Figure 7:
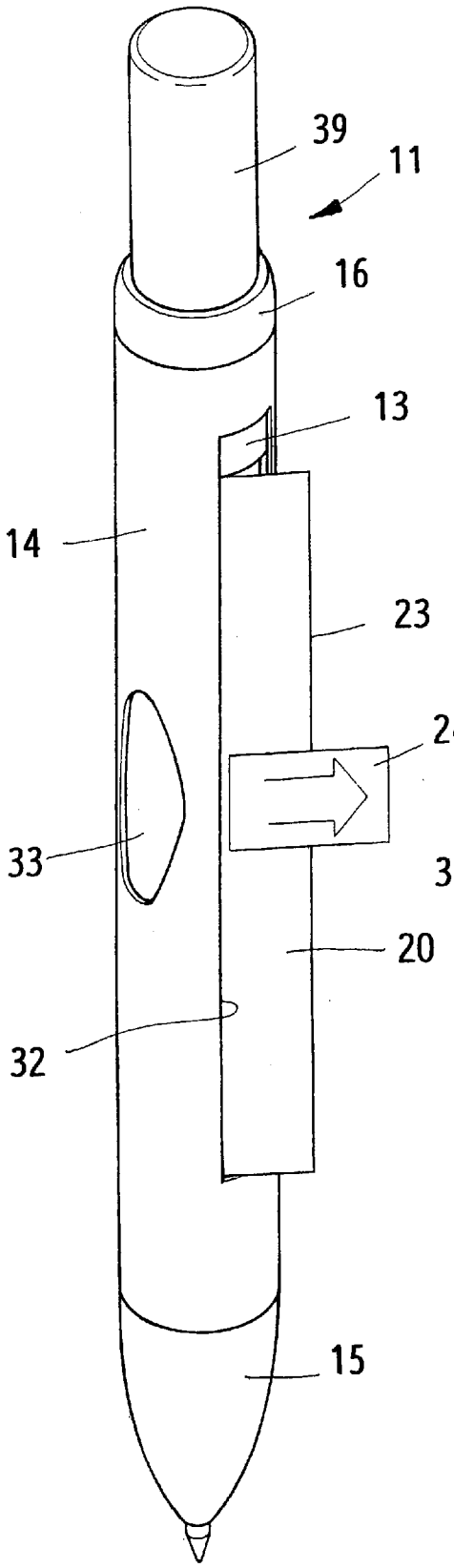
FIG. 7 is a perspective view of the present invention, showing the glue label of a paper roll pulled out.
Figure 8:
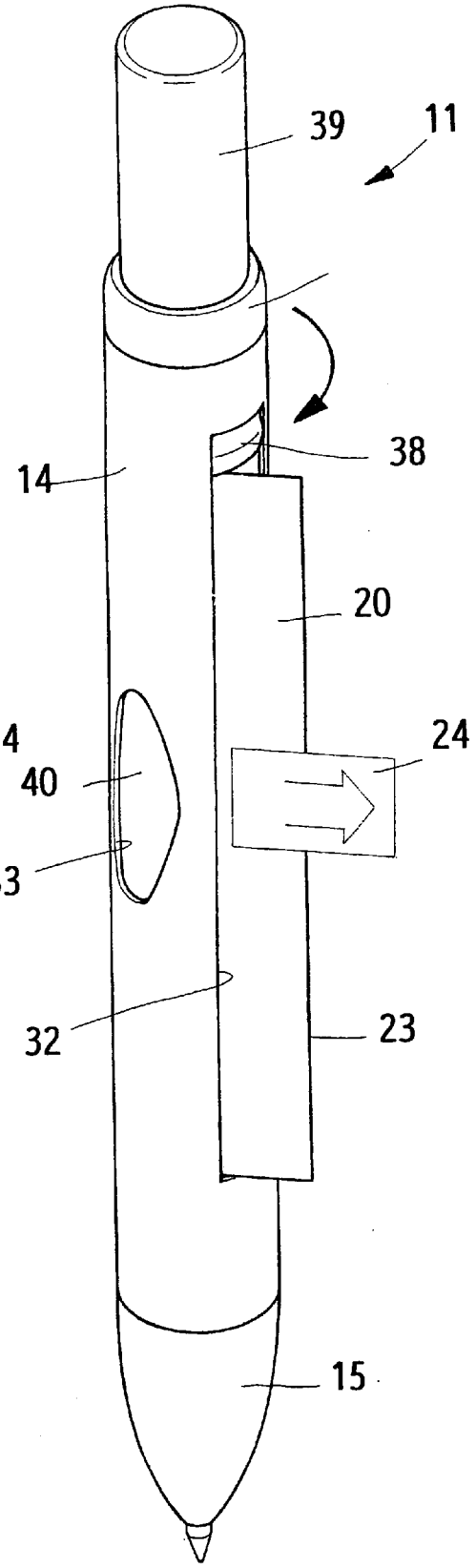
FIG. 8 is a perspective view of the present invention, showing the inner tube and the outer tube being rotated to a fastened position.

Referring to FIGS. 2, 3, 6 to 8, when mount the paper roll 20, the pen head 15 and the spring 25 must be removed first, and then turn the inner and outer tubes 13 and 14 so as to have the elongate slots 31 and 32 aligned each other as shown in FIG. 6; then, the paper roll 20 with a glue label 24 is mounted to the ink tube 19 until the paper roll being plugged into the cylindrical hole 28 of the elongate slot 31; then, set the glue label 24 in the elongate slots 31 and 32; mount the spring 25 to the ink tube 19, and screw the pen head 15 with the inner threads 34 of the inner tube 13. As shown in FIG. 7, pull the paper end 23 of the paper roll 20 out of the elongate slots 31 and 32; use one hand to hold the paper end 23 and the outer tube 14, while the other hand holds the rotation cap 16 and turn until the catch point 38 of the inner tube 13 being engaged with the elongate slot 32 of the outer tube 14; as shown in FIG. 8, the inner and outer tubes 13 and 14 will be set in place without loosening and turning. The paper end 23 and the glue label 24 will be out of the elongate slot 32 of the outer tube 14; use the thumb of one hand to press the paper surface 40 in the paper-pushing hole 33, while the other hand can pull and tear a piece of paper; in that case, the user would feel a resistance to prevent the paper roll 20 from being pulled.

Before tearing off the first paper end 23, turn the elongate slot 31 of the inner tube 13 towards the paper-pushing hole 33 of the outer tube 14 so as to have the paper surface of the paper roll moved into a gap 30 between the inner tube 13 and the outer tube 14. Since the gap 30 is well designed in advance, it would not cause any hindrance to the paper surface, such as being too tight, deforming or two loose.

Before tearing off the first paper end 23, pull the paper surface of paper roll 20 into the gap 30 between the inner tube 13 and the outer tube 14; after the catch point 38 of the inner tube 13 engages with the elongate slot 32 of the outer tube 14, the paper surface of the paper roll 20 will pass through the paper-push hole 33 of the outer tube 14; the lower edge of the paper surface 40 will be in close contact with the surface of the inner tube 13, and the surfaces of the inner and outer tubes 13 and 14 will provide the paper surface with a suitable clamp force; the other end of the paper-roll cylinder 21 is mounted to the ink tube 19; as a result of the flexible pushing force of the spring 25, the paper roll 20 in the cylindrical hole 28 of the inner tube 13 would not have any loose condition from the second use to the last use.

Figure 9:
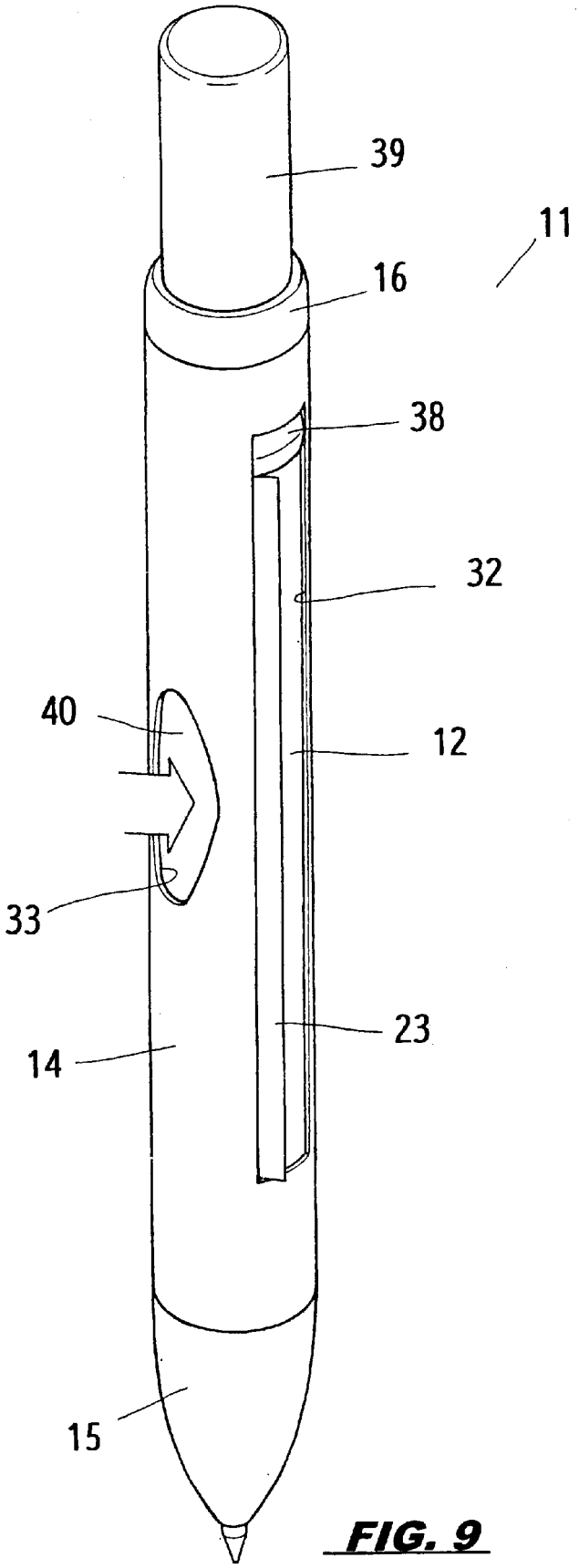
FIG. 9 is a perspective view of the present invention, showing the paper end of a power roll pushed to the elongate slot.

Before tearing off the second slip paper 12 as shown in FIG. 9, the paper end 23 of the paper roll 20 is stored in the gap 30 beside the elongate slot 32 of the outer tube 14; as soon as a thumb presses to the paper-pushing hole 33 and pushes the paper surface 40 towards the elongate slot 32, the paper end 23 of the paper roll 20 will move out of the elongate slot 32 to facilitate the slip paper 12 to be pulled out.

During the second time of pulling the slip paper 12 up to a given length, use a thumb to press the paper surface in the paper-pushing hole 33 to discontinue the pulling; then, tear off a piece of paper along the edge of the elongate slot 32 in accordance with the length desired.

In the present invention, a gap is furnished between the inner tube 13 and the outer tube 14; the paper end 23 of the paper roll 20 can be pulled out through the elongate slots 31 and 32; after the inner and outer tubes 13 and 14 are positioned by rotating, the paper surface 40 of the slip paper 12 will pass through the paper-pushing hole 33 of the outer tube 14; then, use a thumb to push the paper end 23 outer of the elongate slot 32 of the outer tube 14 so as to facilitate the slip paper to be pulled.

According to the aforesaid description of the embodiment, the features and the structure of the present invention have been disclosed completely, and it is apparent that the present invention has provided an obvious improvement, which is never anticipated and achieved by any person in the field; further, the structure thereof is also deemed unique.

What is claimed is:

1. A pen with a built-in slip paper comprising:

a rotation cap;

an inner tube, of which one end is riveted to said rotation cap, while the other end thereof is screwed to a pen head; a center cylindrical hole of said inner tube being loaded with a paper roll which is to be mounted on an ink tube; one side of said inner tube furnished with an elongate slot for a paper end to be pulled out; a catch point furnished beside one end of said elongate slot to be engaged with an outer tube upon said slip paper being rotated so as to provide a positioning function;

said outer tube mounted over said inner tube, but separated from said inner tube at a gap said outer tube having an elongate slot corresponding to said elongate slot of said inner tube; a paper-pushing hole furnished beside said outer tube elongate slot to facilitate a paper end of said slip paper to be pushed out by using a thumb.

2. A pen with a built-in slip paper as claimed in claim 1, wherein the length of said outer tube is slightly longer than said inner tube; when said outer tube is mounted over said inner tube, the ends of said inner and outer tubes near said rotation cap being in register condition; other end of said inner tube screwed to outer threads of said pen head, while said outer tube is mounted to a cylindrical surface on said pen head below said outer threads so as to provide said gap between said inner and outer tubes.

3. A pen with a built-in slip paper as claimed in claim 1, wherein the upper end of said outer tube elongate slot is slightly higher than said catch point furnished on said inner tube; said catch point to be engaged with said elongate slot of said outer tube so as to provide a positioning function.

4. A pen with a built-in slip paper as claimed in claim 1, wherein ends of said inner and outer tubes near said rotation cap are in register condition; a catch hole furnished in said outer tube, and corresponding to a position of said catch point on said inner tube so as to provide a positioning function upon rotating said inner and outer tubes.

* * * * *